US006892642B2

(12) United States Patent
De Vroome

(10) Patent No.: US 6,892,642 B2
(45) Date of Patent: May 17, 2005

(54) DEVICE AND METHOD FOR COOLING A MATERIAL WEB

(75) Inventor: Clemens Johannes Maria De Vroome, Beugen (NL)

(73) Assignee: Goss International Corporation, Bolingbrook, IL (US)

( * ) Notice: Subject to any disclaimer, the term of this patent is extended or adjusted under 35 U.S.C. 154(b) by 0 days.

(21) Appl. No.: 10/146,580

(22) Filed: May 15, 2002

(65) Prior Publication Data

US 2003/0029342 A1 Feb. 13, 2003

(30) Foreign Application Priority Data

May 15, 2001 (DE) ..... 101 23 489

(51) Int. Cl.[7] ..... B41F 23/04

(52) U.S. Cl. ..... 101/487; 101/484; 101/486; 101/488

(58) Field of Search ..... 101/484, 486, 101/487, 488, 483, 424.1, 424; 34/461

(56) References Cited

U.S. PATENT DOCUMENTS 4,481,790 A 11/1984 Mattes
4,501,072 A * 2/1985 Jacobi et al. ..... 34/267
4,944,673 A * 7/1990 Jacobs et al. ..... 432/59
5,676,754 A * 10/1997 Helms et al. ..... 118/101
6,109,184 A * 8/2000 Wech ..... 101/487
6,318,263 B1 * 11/2001 De Vroome ..... 101/424.1
6,481,118 B1 * 11/2002 De Vroome ..... 34/461

FOREIGN PATENT DOCUMENTS

DE 32 28 124 A1 11/1983
DE 199 45 272 A1 6/2001
EP 0 997 697 A2 5/2000

* cited by examiner

*Primary Examiner*—Andrew H. Hirshfeld
*Assistant Examiner*—Marissa Ferguson
(74) *Attorney, Agent, or Firm*—Laurence A. Greenberg; Werner H. Stemer; Ralph E. Locher

(57) ABSTRACT

A device for cooling a material web in a web-fed rotary printing machine, includes a heating device for producing waste heat for evaporative cooling of a cooling medium, and a cooling configuration through which the cooling medium is directable for web cooling. A first quantity of the cooling medium is evaporated and a second quantity is cooled by removal of heat of evaporation. A vapor generator produces vapor at least partly by the waste heat from the heating device. At least one vapor-jet vacuum nozzle is operatable by the vapor for producing a negative pressure. The cooling medium is to be subjected to negative pressure in a negative-pressure chamber for at least partial evaporation and for cooling. A dryer including the cooling device, a printing machine including the cooling device or the dryer and a cooling method are also provided.

16 Claims, 1 Drawing Sheet

DEVICE AND METHOD FOR COOLING A MATERIAL WEB

BACKGROUND OF THE INVENTION

Field of the Invention

The invention relates to a device and a method for cooling a material web, in particular a printed paper web, which has been heated in a hot-air dryer, in a web-fed rotary printing machine.

For printing material webs, for example paper webs, in web-fed rotary printing machines, it has become known heretofore, for a web printed with heat-set inks, after the web has left the final printing unit, to be routed through a dryer, for example a hot-air dryer, wherein the web is dried by being subjected to hot air of, for example, approximately 300° C. as the web runs through the dryer. After the web has left the dryer, the temperature thereof, for example, is approximately 100° C. and, before it is fed to a downstream folder, it is routed through a cooling arrangement, for example a cooling-roller stand, wherein it is routed around cooling rollers, which have a cooling liquid flowing therethrough, and is cooled in the process to approximately 20° C., for example. This results in a full setting of the printing ink on the material web, so that, in the downstream folder, the material web can be folded in a desired manner without smearing and, thus, without adversely affecting the printed image.

In the hot-air dryer, the necessary increase in temperature is produced, for example, by combustion of a combustible gas in a combustion chamber and/or the post-combustion of solvent evaporated from the material web, a quantity of the heated and post-combusted air always being fed, as non-utilized energy, in the form of waste heat to a chimney. At the same time, in order to operate the cooling arrangement, i.e., in order to operate a refrigerating machine, for example, a compression refrigerating machine, assigned to the cooling arrangement, a cooling capacity in the order of magnitude of, for example, 100 kW is required.

The published European Patent Document EP A 0 997 697 discloses a device for drying and cooling newly printed paper webs, wherein heat energy necessary for operating an absorption refrigerating machine by the hot waste gas is fed to a post-combustion chamber. For this purpose, the hot waste gas is initially fed to a heat exchanger, wherein some of the heat is transferred to a heating medium in a first circuit or circulatory loop, the heating medium flowing through a heating coil in a boiler. In the boiler, gaseous refrigerant is expelled from a refrigerant solution, for example, an ammonia solution, at elevated temperature and elevated pressure and is fed, in a second circuit, to a condenser, wherein a cooling coil, which is connected to a recooler and belongs to a third circuit, is arranged. In the condenser, the gaseous coolant is condensed by heat exchange with pump-circulated cooling water of the third circuit and, in the second circuit, is fed, via an expansion valve, to an evaporator wherein there is arranged, in turn, a heating coil which is connected to the cooling batteries of a cooling arrangement via a fourth circuit. Via the heating coil in the evaporator, heat is transferred to the refrigerant and thus cools a heat carrier in the fourth circuit. From the evaporator, the refrigerant vapor passes, at low pressure, via the second circuit to an absorber, where it is absorbed in refrigerant solution of low concentration. A cooling coil of a fifth circuit is arranged in the absorber and dissipates the absorption heat released in the absorber. The then enriched refrigerant solution is pumped back, within the second circuit, by a pump, under elevated pressure, into the boiler, while, at the same time, solution with a low level of refrigerant is fed to the absorber from the boiler via a regulating valve.

The foregoing drying and cooling device is disadvantageous in that it has a construction of high outlay or expense, includes, in particular, five separate heating and coolant circuits and, therefore, on the one hand, calls for high investment and operation costs and, on the other hand, has very large dimensions, so that a correspondingly large amount of floor space must be provided, at high cost. It is also disadvantageous that, for operation, the foregoing drying and cooling device requires an easily volatile refrigerant which, in the event of leakage of the usually closed second circuit, can pass out into the pressure chamber and constitute a hazard to the environment and to health.

Also heretofore known from the prior art are vapor-jet vacuum pumps, for example, such pumps as are sold by Schutte & Koerting, which produce a vacuum by vapor subjected to high pressure. For this purpose, the vapor subjected to high pressure is initially fed to a nozzle, from which, the vapor flows, with a reduction in pressure and simultaneous increase in speed, into a tapering section of the vapor-jet vacuum nozzle, the tapering section being disposed downstream from the nozzle, as viewed in the vapor flow direction. In this regard, a vacuum is produced, for example, at a lateral opening connected to the central section. The vapor then flows through a widening section of the vapor-jet vacuum nozzle, the speed decreasing again and the pressure of the vapor increasing again, with the result that the vapor can escape from the vapor-jet vacuum nozzle counter to an external pressure.

SUMMARY OF THE INVENTION

Accordingly, it is an object of the invention to provide a device for cooling a material web having a relatively simple and straightforward construction, with a resulting economy of costs and a simultaneous high level of reliability. It is also an object of the invention of the instant application to provide a device for cooling a material web, which has only a very small number of moving parts and operates without chemicals which would otherwise place special requirements on the construction and the operation of the cooling device.

With the foregoing and other objects in view, there is provided, in accordance with one aspect of the invention, a device for cooling a material web, more particularly, a printed paper web, which has been heated in a hot-air dryer, in a web-fed rotary printing machine, comprising a heating device for producing waste heat utilizable by the cooling device for evaporative cooling of a cooling medium, and a cooling arrangement through which the cooling medium is directable for cooling the material web, a first quantity of the cooling medium being evaporated and a second quantity of the cooling medium being cooled by removal of heat of evaporation, and further comprising at least one vapor generator for producing vapor at least partly by the waste heat from the heating device, at least one vapor-jet vacuum nozzle operatable by the vapor and serving for producing a negative pressure, and a negative-pressure chamber wherein the cooling medium is subjectible to the negative pressure for the at least partial evaporation and for the cooling.

In accordance with another feature of the invention, the at least one vapor-jet vacuum nozzle includes a first vapor-jet vacuum nozzle for producing a first negative pressure to which the cooling medium is subjectible, and at least a second vapor-jet vacuum nozzle for producing a second negative pressure greater than the first negative pressure and to which the cooling medium is subjectible.

In accordance with a further feature of the invention, the negative-pressure chamber has at least two sections or sub-chambers connected to one another for exchanging cooling medium, the sections or sub-chambers being subjectible to negative pressures of different amounts.

In accordance with an added feature of the invention, the cooling device further comprises a temperature-measuring unit for determining the temperature of the cooling medium before the cooling medium is directed through the cooling arrangement, and a control/regulating unit for controlling/regulating flowthrough of vapor through the vapor-jet vacuum nozzle in dependence upon the temperature.

In accordance with an additional feature of the invention, the cooling device further comprises a pump installed in a feed line extending from the vacuum chamber to the cooling arrangement, a pressure-measuring unit for determining pressure difference of the cooling medium upstream and downstream from the pump, and a control/regulating unit for controlling/regulating capacity of the pump in dependence upon the pressure difference.

In accordance with yet another feature of the invention, the cooling medium in the vacuum chamber has a temperature regulatable to approximately 10° C. to 20° C., and the cooling medium in the vacuum chamber has a pressure regulatable to approximately 12 mbar.

In accordance with yet a further feature of the invention, the heating device is a hot-air dryer.

In accordance with yet an added feature of the invention, the heating device is one of a combustion chamber and a post-combustion device of a hot-air dryer.

In accordance with yet an additional feature of the invention, the cooling device has at least one cooling roller through which the cooling medium is routed, the cooling roller having a diameter ranging from 150 mm to 250 mm.

In accordance with another aspect of the invention, there is provided a dryer, more particularly, a hot-air dryer, including a device for cooling a material web in a web-fed rotary printing machine, comprising a heating device for producing waste heat utilized by the cooling device for evaporative cooling of a cooling medium, and a cooling arrangement through which the cooling medium is directable for cooling the material web, a first quantity of the cooling medium being evaporated and a second quantity of the cooling medium being cooled by removal of heat of evaporation, and further comprising at least one vapor generator for producing vapor at least partly by the waste heat from the heating device, at least one vapor-jet vacuum nozzle integrated in the dryer, the vacuum nozzle being operatable by the vapor and serving for producing a negative pressure, and a negative-pressure chamber wherein the cooling medium is subjectible to the negative pressure for the at least partial evaporation and for the cooling.

In accordance with a further feature of the invention, the dryer is a hot-air dryer.

In accordance with an additional aspect of the invention, there is provided a printing machine, more particularly, a web-fed rotary printing machine, having a device for cooling a material web therein, the cooling device comprising a heating device for producing waste heat utilizable by the cooling device for evaporative cooling of a cooling medium, and a cooling arrangement through which the cooling medium is directable for cooling the material web, a first quantity of the cooling medium being evaporated and a second quantity of the cooling medium being cooled by removal of heat of evaporation, and further comprising at least one vapor generator for producing vapor at least partly by the waste heat from the heating device, at least one vapor-jet vacuum nozzle operatable by the vapor and serving for producing a negative pressure, and a negative-pressure chamber wherein the cooling medium is subjectible to the negative pressure for the at least partial evaporation and for the cooling.

In accordance with yet another aspect of the invention, there is provided a printing machine having a dryer including a device for cooling a material web in the printing machine, comprising a heating device for producing waste heat utilizable by the cooling device for evaporative cooling of a cooling medium, and a cooling arrangement through which the cooling medium is directable for cooling the material web, a first quantity of the cooling medium being evaporated and a second quantity of the cooling medium being cooled by removal of heat of evaporation, and further comprising at least one vapor generator for producing vapor at least partly by the waste heat from the heating device, at least one vapor-jet vacuum nozzle integrated in the dryer, the vacuum nozzle being operatable by the vapor and serving for producing a negative pressure, and a negative-pressure chamber wherein the cooling medium is subjectible to the negative pressure for the at least partial evaporation and for the cooling.

In accordance with a further feature of the invention, the last-mentioned printing machines are web-fed rotary printing machines.

In accordance with a concomitant aspect of the invention, there is provided a method of cooling a material web in a web-fed rotary printing machine, which comprises utilizing waste heat from a heating device for evaporative cooling of a cooling medium, directing the cooling medium through a cooling arrangement, for cooling the material web, evaporating a first quantity of the cooling medium and cooling a second quantity of the cooling medium by removal of heat of evaporation, and which more specifically comprises the method steps of producing vapor, at least partly by the waste heat from the heating device, applying the vapor for operating a vapor-jet vacuum nozzle and producing a negative pressure by the vapor-jet vacuum nozzle, and subjecting the cooling medium to the negative pressure for the at least partial evaporation and for the cooling of the cooling medium.

In other words, the device according to the invention for cooling a material web, in particular, a printed paper web that has been heated in a hot-air dryer, in a web-fed rotary printing machine, the cooling device utilizing waste heat from a heating device for evaporative cooling of a cooling medium which, for cooling the material web, is directed through a cooling arrangement, a first quantity of the cooling medium being evaporated and a second quantity of the cooling medium being cooled by removal of heat of evaporation, is distinguished by at least one vapor generator wherein vapor is produced, at least partly by the waste heat from the heating device, at least one vapor-jet vacuum nozzle, which is operated by the vapor and which produces a negative pressure, and a negative-pressure chamber wherein the cooling medium is subjected to the negative pressure for the at least partial evaporation and for the cooling.

According to the invention, the device for cooling material webs only has a very small number of components, which are easy to operate, with the result that, on the one hand, the purchase and operation of the cooling device involves only low costs, while, on the other hand, operating the cooling device can be carried out likewise at low cost and, at the same time, with a very high level of reliability. The cooling device according to the invention has a vapor-jet vacuum nozzle which, in relation to the capacity produced thereby, has a very small overall volume, with the result that it may advantageously be arranged, without any significant conversion work being required, in the vicinity of, or in, the device for cooling a material web. It is also advantageously the case that such a vapor-jet vacuum nozzle does not have any moving parts, with the result that, during operation, only a very low level of wear, or even no significant level of wear, occurs, due to which, in turn, costs and the amount of repair work required are reduced. The cooling device according to the invention, furthermore, utilizes, at least in part, the waste heat from a heating device, and thus there advantageously results a large reduction in energy and costs.

In a further embodiment of the cooling device according to the invention, the cooling device may have both a first vapor-jet vacuum nozzle, which produces a first negative pressure, to which the cooling medium is subjected, and at least a second vapor-jet vacuum nozzle, which produces a second negative pressure, which is greater than the first negative pressure and to which the cooling medium is subjected.

By using a plurality of vapor-jet vacuum nozzles, it is advantageously possible in a stepwise manner to produce the desired vacuum over the cooling medium in the negative-pressure chamber. For this purpose, the first vapor-jet vacuum nozzle may produce a preliminary vacuum or negative pressure, from which at least a further vapor-jet vacuum nozzle produces either the desired vacuum or negative pressure or, in turn, merely an intermediate vacuum or negative pressure, which can then be reduced in a stepwise manner by further vapor-jet vacuum nozzles. As a result, it is, for example, also advantageously possible to operate, instead of one extremely high-capacity vapor-jet vacuum nozzle, a plurality of lower-capacity vapor-jet vacuum nozzles for producing a desired vacuum or negative pressure. Because the vapor-jet vacuum nozzles, as has already been explained hereinbefore, have advantageously small dimensions, an advantage further results in that, even if use is made of a plurality of vapor-jet vacuum nozzles in the device for cooling a material web, only a comparatively small amount of space is required overall.

Furthermore, it is also possible for the negative-pressure chamber to have at least two sections or at least two sub-chambers which are connected to one another for the exchange of cooling medium, the sections or the sub-chambers being subjected to negative pressures of different amounts.

It is thus possible, for example, for each of the sections or sub-chambers to be evacuated, by a dedicated vapor-jet vacuum nozzle assigned thereto, to a respective desired vacuum or negative pressure and, as a result, for the desired end vacuum to be formed in the last of the interconnected sections or sub-chambers.

It is further possible for the cooling device to be provided with a temperature-measuring unit and a control/regulating unit, the temperature-measuring unit determining the temperature of the cooling medium before the cooling medium is directed through the cooling arrangement, and the control/regulating unit controlling/regulating the flowthrough of vapor through the vapor-jet vacuum nozzle in dependence upon the temperature.

In the case of an increase in the flowthrough of vapor through the vapor-jet vacuum nozzle, the latter produces a higher vacuum, as a result of which the quantity of evaporated cooling medium increases and, at the same time, the cooling medium left behind in the negative-pressure chamber is cooled to a more pronounced extent. A reduction in the vapor flowthrough results, in the same way, in reduced cooling of the cooling medium in the negative-pressure chamber. For controlling/regulating the temperature of the cooling medium, it is thus possible, in an advantageously straightforward manner, on account of the measured temperature of the cooling medium before it is directed through the cooling arrangement, to influence the vapor flowthrough, for example by activating a valve, in the desired manner. The adjustment or regulation, for example, of a predetermined temperature of the cooling medium can thus be carried out in a straightforward manner and at a quick rate of reaction. For regulating the temperature, the control/regulating arrangement may have a regulating device which is configured in a conventional manner and compares the measured temperature value, as actual value, with a predetermined temperature value, as desired or nominal value, and carries out the regulation in dependence upon the deviation between the two values.

A further configuration of the cooling device according to the invention may have a pump, a pressure-measuring unit and a control/regulating unit, it being possible for the pump to be installed in a feed line from the vacuum chamber to the cooling arrangement, it being possible for the pressure-measuring unit to determine the pressure difference of the cooling medium upstream and downstream from the pump, and the control/regulating unit controlling/regulating the capacity of the pump in a conventional manner in dependence upon the pressure difference.

As a result, it is advantageously possible to adjust the pressure of the cooling medium in the desired manner before the cooling medium is directed through the cooling arrangement.

A further cooling device according to the invention may be distinguished in that the temperature of the cooling medium is regulated to approximately 10° C., and the pressure of the cooling medium is regulated to approximately 1.7 bar.

Furthermore, it is also possible for the heating device, the waste heat of which is utilized for the vapor generation, to be a hot-air dryer, in particular, a combustion chamber or a post-combustion arrangement of a hot-air dryer.

Because, particularly during operation of web-fed rotary printing machines, hot-air dryers are used for drying the printed material web, the waste heat of the dryers having the amount of energy which is necessary for operating a device for cooling the material web, it is advantageous for the operation of the device for cooling a material web to be combined with the operation of the heating device so that the waste heat, i.e., the lost energy, from the hot-air dryer, flows, at least in part, directly as effective energy into the cooling device. This is advantageous in particular because the dryer and the cooling arrangement are arranged in the vicinity of one another, with the result that long feed lines, which in particular have to be heat-insulated, may be dispensed with. Also when operating a hot-air dryer with an integrated cooling arrangement, for example, with an integrated cooling-roller stand, it is particularly advantageous for the latter to be provided with a device according to the invention for cooling a material web. It is advantageously possible here, with a reduction in the amount of floor space required, for example, for the entire device for cooling the material web to be integrated in the dryer, although it is also conceivable, for example, for only the vapor-jet vacuum nozzles to be integrated in the dryer. Because the vapor-jet vacuum nozzles, on account of the functional principle thereof, have an elongated construction, it is advantageously recommended for them to be integrated in the likewise elongated construction of a dryer, in particular a hot-air dryer.

A further embodiment of the invention may be distinguished in that the cooling arrangement comprises at least one cooling roller through which the cooling medium is routed and which has, in particular, a diameter in the range from 150 mm to 250 mm.

Operating a cooling arrangement with at least one cooling roller in conjunction with the cooling device according to the invention, furthermore, results in the advantage that the cooling medium cooled by the cooling device can be routed directly through the cooling rollers, with the result that it is advantageously possible to dispense with further heat exchangers and cooling media. By selecting the diameter of the cooling rollers in the range from 150 mm to 250 mm, i.e., by selecting a relatively small diameter for the cooling rollers, it is further advantageous that it is possible for the cooling rollers, which for example have a hollow interior, to have a relatively small quantity of coolant flowing therethrough in order to produce the desired cooling effect. As a result, the connection between the cooling device according to the invention, which only requires a small amount of space, and a cooling-roller stand, which has cooling rollers of small diameters, overall results in a cooling arrangement which reduces to a considerable extent the amount of floor space required for the web-fed rotary printing machine as a whole.

It is also an object of the present invention to provide a method of cooling a material web which, with low costs and effort and a simultaneous high level of reliability, effects the desired cooling of a material web.

With this and other objects in view, there is provided, in accordance with the invention, a method of cooling a material web, in particular a printed paper web that has been heated in a hot-air dryer, in a web-fed rotary printing machine, waste heat from a heating arrangement being utilized for the evaporative cooling of a cooling medium which, for cooling the material web, is directed through a cooling arrangement, and a first quantity of the cooling medium being evaporated and a second quantity of the cooling medium being cooled by removal of heat of evaporation, is distinguished by the following method steps: producing vapor, at least in part, by the waste heat from the heating arrangement; operating a vapor-jet vacuum nozzle by the vapor and producing a negative pressure by the vapor-jet vacuum nozzle, and subjecting the cooling medium to a negative pressure, for the at least partial evaporation and for the cooling of the cooling medium.

In the implementation of the method according to the invention, a cooling medium is advantageously cooled at low costs and with low levels of effort, the method also always being very reliable overall on account of the small number of method steps and the straightforwardness with which they can be performed, respectively. Producing a negative pressure by the vapor-jet vacuum nozzle takes place without moving parts and without special chemicals, with the result that no signs of wear are to be expected, and special safety measures may be dispensed with.

Other features which are considered as characteristic for the invention are set forth in the appended claims.

Although the invention is illustrated and described herein as a device and method for cooling a material web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIG. 1 of the drawing, wherein:

DESCRIPTION OF THE PREFERRED EMBODIMENTS

Figure 1:
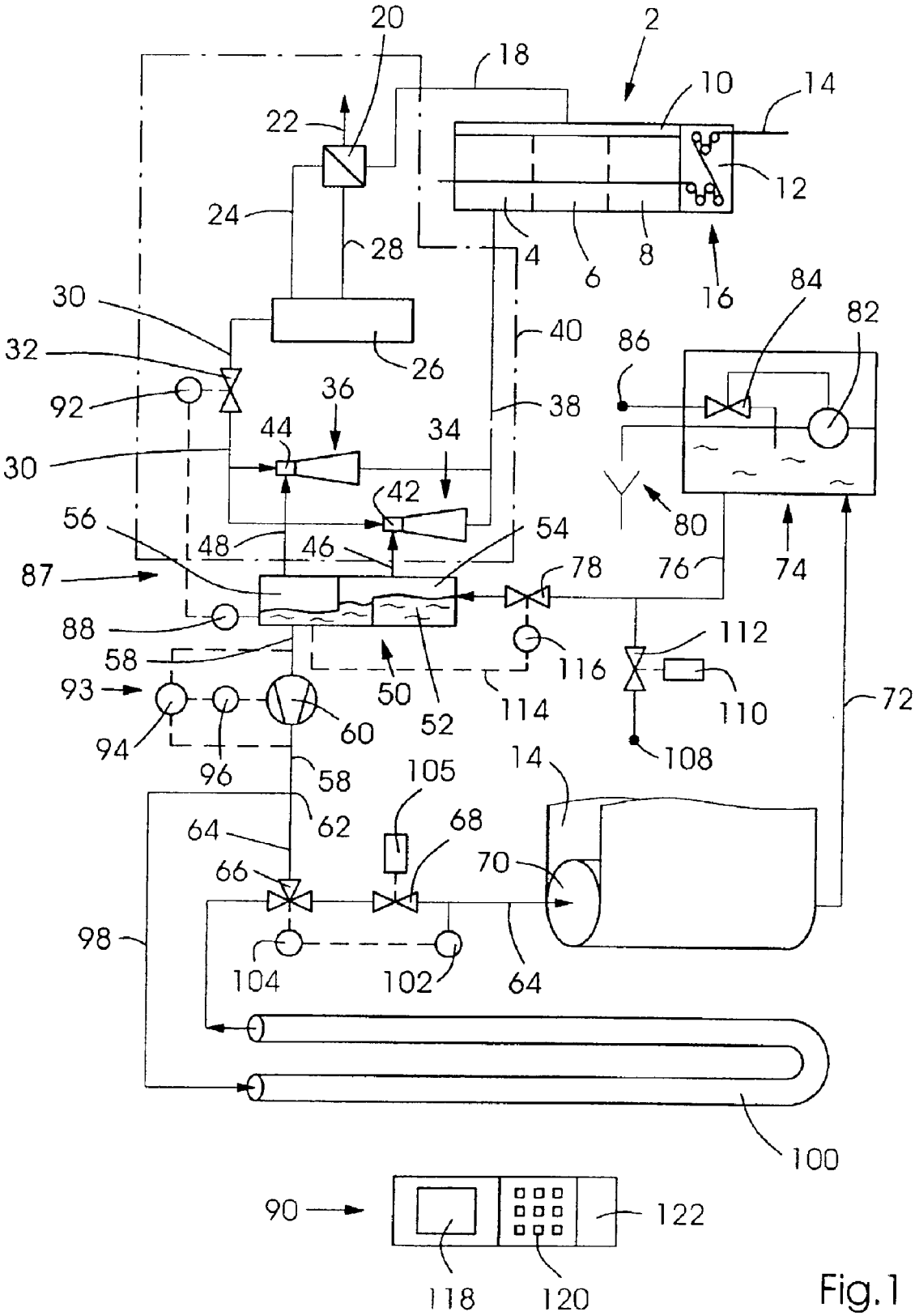
FIG. 1 is a schematic drawing of the cooling device according to the invention.

Referring now to FIG. 1 of the drawing, there is shown therein a hot-air dryer 2 having three sections 4, 6 and 8, a combustion chamber 10 and an integrated cooling-roller stand 12, a printed paper web 14 being routed around cooling rollers 16 through the dryer 2. Hot waste air produced by the hot-air dryer 2 is fed, via a line 18, to a heat exchanger 20 and is expelled from the latter via a chimney 22. Heated in the heat exchanger 20 is a heating medium which is fed, via a feed line 24, to a vapor generator 26, and is routed from the latter, via a return line 28, to the heat exchanger 20. It is also possible, however, for the vapor generator 26 to be operated directly by the hot waste gases from the hot-air dryer 2 via the line 18, thereby dispensing with the heat exchanger 20. The vapor, for example water vapor, produced in the vapor generator 26 is routed via a line 30, wherein a controllable valve 32 is installed, to a first vapor-jet nozzle 34 and to a second vapor-jet nozzle 36, from which the vapor can be routed back in turn, via a line 38, to one of the sections of the hot-air dryer 2. In this case, it is also possible, for example, for the components shown within that region of FIG. 1 bounded by the dot-dash or phantom line 40 to be arranged inside the hot-air dryer 2. When the vapor flows through the first and the second vapor-jet vacuum nozzles 34 and 36, a respective vacuum is produced at the locations 42 and 44, which have a narrowed cross section, a vacuum chamber 50 containing a cooling medium 52 being subjected to the vacuum via laterally applied lines 46 and 48. Due to the vacuum produced over the cooling medium 52 in the vacuum chamber 50, the cooling medium evaporates partially, the vapor being drawn, via the lines 46 and 48, into the vapor jet and being removed via the line 38. The vacuum chamber 50 has a first section 54, wherein, by the vapor-jet vacuum nozzle 34, a first vacuum is produced via the cooling medium 52, and also has a second section 56, wherein, by the vapor-jet vacuum nozzle 36, a second vacuum is produced, the latter being higher than the first vacuum in the first section 54. By evaporating the cooling medium 52 in the vacuum chamber 50, the cooling medium is cooled by removal of the heat of evaporation and can be pumped out of the second section 56 of the vacuum chamber 50 via a line 58, in which a pump 60 is installed. The cooling medium is then routed, at a given temperature and a given pressure, from a branching point 62, via a line 64, a mixing valve 66 and a shut-off valve 68, to a cooling roller 70 of the cooling-roller stand 12, and is directed therethrough. For illustrative reasons, the cooling roller 70 is shown in an enlarged state outside the cooling-roller stand 12. By virtue of the cooled cooling medium flowing through the cooling rollers 70, the surface of the cooling roller is kept at a low temperature level, with the result that a paper web 14 routed over the surface is cooled by contact with the surface. After the cooling medium has flowed through the cooling roller 70, it is fed, via a line 72, to a reservoir 74, wherein the cooling medium is stored and wherefrom the latter can be routed back into the vacuum chamber 50 via a line 76 and via a valve 78. In order to ensure a constantly high level of cooling medium in the reservoir 74, the latter has, on the one hand, an overflow 80 and, on the other hand, a valve 84 which can be actuated by way of a float 82 and via which, in the case of a decreasing level of cooling medium in the reservoir 24, cooling medium can be fed to the reservoir from an infeed 86. For the purpose of controlling or for the purpose of regulating to predetermined values, the cooling device according to the invention may comprise further components. It is thus possible, for example, for the vacuum chamber 50 to be provided with a temperature-measuring arrangement 88 which determines the temperature of the cooling medium in the vacuum chamber, the measured temperature values being fed, for example, to a control/regulating arrangement 90 which, in dependence upon the temperature values which are measured and possibly predetermined, actuates the regulating valve 32 in the line 30 by a motor 92. Depending upon the opening state of the valve 32, it is possible to adjust the pressure of the vapor fed to the vapor-jet vacuum nozzles 34 and 36, as a result of which it is consequently possible to influence the vacuum produced at the locations 42 and 44. Because this vacuum, in turn, influences the quantity of evaporated cooling medium in the vacuum chamber 50, and thereby the quantity of heat of evaporation removed, it is possible in this way for the temperature of the cooling medium to be adjusted precisely. It is further possible, with the aid of a pressure-measuring arrangement 94, to determine the pressure difference between measuring locations upstream and downstream from the pump 60, it likewise being possible for the measured value to be fed to the control or regulating arrangement 90 which, dependent upon the measured value and possibly predetermined pressure-difference values, increases or decreases the capacity of the pump 60 via a motor 96, with the result that the pressure at which the cooling medium is routed through the cooling roller 70 can be adjusted in a desired manner, i.e., to a desired value. It is further possible for the cooling medium to be routed from the branching point 62, via a line 98, through a heating region 100, wherein the cooling medium is heated. A further temperature-measuring arrangement 102 can be used for measuring the temperature of the cooling medium before the cooling medium is directed through the cooling roller 70, it being possible for the measured values, in turn, to be fed to the control/regulating arrangement, which can actuate the mixing valve 66 via a motor 104, for example, in dependence upon the operating state of the web-fed rotary printing machine, as a result of which cooled cooling medium from the vacuum chamber is mixed with heated cooling medium from the heating region 100 and is fed to the cooling roller 70. It is thus possible, for example, when the machine is at a standstill, for the temperature level of the cooling medium to be increased from an operating temperature of approximately 10°C. to approximately 20°C. by actuation of the mixing valve, with the result that there is no condensation on the cooling rollers when the machine is at a standstill. Furthermore, it is possible to provide, in the line 64, a shut-off valve 68 by which it is possible to prevent the inflow of cooling medium to the cooling rollers, it being possible for the shut-off valve 68 to be actuated, for example, via an electromagnetically operating actuating arrangement 105. For filling the vacuum chamber 50 with cooling medium, the line 76 is connected to an inflow 108 via a shut-off valve 112, which can likewise be actuated by an actuating arrangement 110. In addition, it is possible for the filling level of the cooling medium in the vacuum chamber 50 to be determined via a non-illustrated filling-level measuring arrangement, it being possible for the latter to be connected, via a line 114, to a motor 116 and the control system for the latter, thereby actuating a valve 78 by which it is possible to adjust the inflow of cooling medium to the vacuum chamber 50.

Such a device for cooling material webs as illustrated in FIG. 1 may be characterized, for example, by the following values: at a paper-web speed of 15 m/s and a width of 1460 mm and with a paper-web weight of 90 g/m$^2$, it is possible for the temperature of the paper web to be reduced from a starting temperature of 80° C. upstream from the cooling-roller stand 12 to an exit temperature of 35° C. downstream from the cooling-roller stand 12, it being necessary for the illustrated device to have a capacity of approximately 115 kWh. For this purpose, water vapor at a pressure of approximately 10 bar and a temperature of approximately 180° C. is produced by the vapor generator, which, directed by way of the two vapor-jet vacuum nozzles, removes approximately 2.8 l/min of water vapor from the vacuum chamber 50. As a result, a negative pressure of approximately 12 mbar is produced in the vacuum chamber 50, and the cooling medium is cooled to approximately 10° C. to 20° C. The temperature-regulating arrangement 87 and the pressure-regulating arrangement 93 bring the cooling medium to a pressure of 1.7 bar and a temperature of 10° C. before the cooling medium flows through the cooling roller 70. After the cooling medium has flowed through the cooling-roller stand 12 and the cooling rollers 16 and 17 thereof, the cooling medium has a pressure of just approximately 1.2 bar and an elevated temperature of 14° C. In this regard, 25 m$^3$ of cooling medium per hour is routed through the cooling rollers 16 and 70 of the cooling roller stand 12. For sufficient dimensioning of the cooling device, the vacuum chamber 50 and the reservoir 74 may each have a volume of approximately 40 l. During operation of such a cooling device for cooling a material web, the utilization of the waste heat from the post-combustion of the dryer 2 is sufficient, with the result that the operation of feeding further energy into the cooling device may be dispensed with.

The control/regulating arrangement 90 may include a display 118, an input unit 120 and a memory 122, wherein it is possible to store measured values, specified or prescribed values and complete control profiles for predefined operating states of the web-fed rotary printing machine. For this purpose, the control/regulating arrangement 90 may be connected, via non-illustrated lines, to the individual measuring arrangements 88, 94 and 102 and the various valves or actuating motors thereof so that specific or targeted activation or regulation of these components can take place by way of automatically running programs in the control/regulating arrangement 90 or also by way of being input manually by an operator.

I claim:

1. A device for cooling a material web in a web-fed rotary printing machine, comprising:

a heating device for producing waste heat to be utilized by the device;

a cooling configuration through which a cooling medium is to be directed for cooling the material web;

at least one vapor generator for producing vapor at least partly by said waste heat from said heating device;

at least one vapor-jet vacuum nozzle to be operated by said vapor for producing a negative pressure; and a negative-pressure chamber containing said cooling medium, a first quantity of said cooling medium being evaporated and a second quantity of said cooling medium being cooled by removal of heat of evaporation, wherein said cooling medium is to be subjected to said negative pressure for said at least partial evaporation and for said cooling, and wherein cooling medium cooled by removal of heat of evaporation is provided to said cooling configuration.

2. The cooling device according to claim 1, wherein said at least one vapor-jet vacuum nozzle includes a first vapor-jet vacuum nozzle for producing a first negative pressure to which said cooling medium is to be subjected, and at least a second vapor-jet vacuum nozzle for producing a second negative pressure greater than said first negative pressure and to which said cooling medium is to be subjected.

3. The cooling device according to claim 2, wherein said negative-pressure chamber has at least two sections or sub-chambers connected to one another for exchanging cooling medium, said sections or sub-chambers to be subjected to negative pressures of different amounts.

4. The cooling device according to claim 1, further comprising a temperature-measuring unit for determining the temperature of said cooling medium before said cooling medium is directed through said cooling configuration, and a control/regulating unit for controlling/regulating flowthrough of vapor through said vapor-jet vacuum nozzle in dependence upon temperature.

5. The cooling device according to claim 4, wherein said cooling medium in said negative-pressure chamber has a temperature to be regulated to approximately 10°C. to 20°C. and said cooling medium in said vacuum chamber has a pressure to be regulated to approximately 12 mbar.

6. The cooling device according to claim 1, further comprising a feed line extending from said negative-pressure chamber to said cooling configuration, a pump installed in said feed line, a pressure-measuring unit for determining a pressure difference of said cooling medium upstream and downstream of said pump, and a control/regulating unit for controlling/regulating a capacity of said pump in dependence upon said pressure difference.

7. The cooling device according to claim 1, wherein said heating device is a hot-air dryer.

8. The cooling device according to claim 1, wherein said heating device is one of a combustion chamber and a post-combustion device of a hot-air dryer.

9. The cooling device according to claim 1, wherein said cooling device has at least one cooling roller through which said cooling medium is routed, and said cooling roller has a diameter ranging from 150 mm to 250 mm.

10. In a web-fed rotary printing machine, a dryer, comprising a device for cooling a material web, said device including:

a heating device for producing waste heat to be utilized by the device;

a cooling configuration through which said cooling medium is to be directed for cooling the material web;

at least one vapor generator for producing vapor at least partly by said waste heat from said heating device;

at least one vapor-jet vacuum nozzle integrated in the dryer, said vacuum nozzle to be operated by said vapor for producing a negative pressure; and a negative-pressure chamber containing said cooling medium, a first quantity of said cooling medium being evaporated and a second quantity of said cooling medium being cooled by removal of heat of evaporation, wherein said cooling medium is to be subjected to said negative pressure for said at least partial evaporation and for said cooling, and wherein cooling medium cooled by removal of heat of evaporation is provided to said cooling configuration.

11. The dryer according to claim 10, wherein the dryer is a hot-air dryer.

12. A printing machine, comprising a device for cooling a material web therein, said cooling device including:

a heating device for producing waste heat to be utilized by the cooling device;

a cooling configuration through which a cooling medium is to be directed for cooling the material web;

at least one vapor generator for producing vapor at least partly by said waste heat from said heating device;

at least one vapor-jet vacuum nozzle to be operated by said vapor and for producing a negative pressure; and a negative-pressure chamber containing said cooling medium, a first quantity of said cooling medium being evaporated and a second quantity of said cooling medium being cooled by removal of heat of evaporation, wherein said cooling medium is to be subjected to said negative pressure for said at least partial evaporation and for said cooling, and wherein cooling medium cooled by removal of heat of evaporation is provided to said cooling configuration.

13. A printing machine, comprising a dryer including a device for cooling a material web in the printing machine, said cooling device including:

a heating device for producing waste heat to be utilized by the cooling device;

a cooling configuration through which a cooling medium is to be directed for cooling the material web;

at least one vapor generator for producing vapor at least partly by said waste heat from said heating device;

at least one vapor-jet vacuum nozzle integrated in the dryer, said vacuum nozzle to be operated by said vapor for producing a negative pressure; and a negative-pressure chamber containing said cooling medium, a first quantity of said cooling medium being evaporated and a second quantity of said cooling medium being cooled by removal of heat of evaporation, wherein said cooling medium is to be subjected to said negative pressure for said at least partial evaporation and for said cooling, and wherein cooling medium cooled by removal of heat of evaporation is provided to said cooling configuration.

14. The printing machine according to claim 13, wherein the printing machine is a web-fed rotary printing machine.

15. The printing machine according to claim 14, wherein the printing machine is a web-fed rotary printing machine.

16. A method of cooling a material web in a web-fed rotary printing machine, which comprises:

utilizing waste heat from a heating device for evaporative cooling of a cooling medium;

directing the cooling medium through a cooling configuration for cooling the material web;

evaporating a first quantity of the cooling medium and cooling a second quantity of the cooling medium by removal of heat of evaporation;

producing vapor, at least partly by the waste heat from the heating device;

applying the vapor for operating a vapor-jet vacuum nozzle and producing a negative pressure by the vapor-jet vacuum nozzle; and subjecting the cooling medium to the negative pressure, for at least partial evaporation and for the cooling of the cooling medium and providing at least a portion of the cooling medium being cooled by removal of heat of evaporation to the cooling configuration.

* * * * *